United States Patent [19]

Hinds

[11] 3,964,041

[45] June 15, 1976

[54] ARTICLE DETECTION SYSTEM AND METHOD

[75] Inventor: James J. Hinds, La Grange, Ill.

[73] Assignee: National Can Corporation, Chicago, Ill.

[22] Filed: July 1, 1974

[21] Appl. No.: 484,768

[52] U.S. Cl. ..... 340/258 B; 235/92 PD; 250/223 R; 340/259

[51] Int. Cl.[2] ..... G08B 13/18

[58] Field of Search ..... 340/258 B, 259; 331/65, 331/66; 250/223 R, 205

[56] References Cited

UNITED STATES PATENTS

| | | | |
|---|---|---|---|
| 2,731,621 | 1/1956 | Southeimer | 340/258 B |
| 2,912,683 | 11/1959 | Bagno | 340/258 B |
| 3,534,351 | 10/1970 | Harnden et al. | 340/258 B |
| 3,605,082 | 9/1971 | Matthews | 340/258 B |
| 3,644,912 | 2/1972 | Perlman | 340/258 B |
| 3,842,257 | 10/1974 | Kohler | 340/258 B |

*Primary Examiner*—David L. Trafton
*Attorney, Agent, or Firm*—James E. Anderson

[57] ABSTRACT

A system and method for sensing and detecting articles such as container ends and for providing count and/or control outputs representative of the number of such articles detected. A sensing signal is impinged against the article to be sensed and a feedback signal representative thereof is generated. This feedback signal is connected to the input of a circuit which generates a fixed frequency signal for modulating the sensing signal at the fixed frequency. This circuit provides a first output signal in response to the presence at its input of a signal oscillating at the fixed frequency and a second output signal in the absence at its input of a signal oscillating at the fixed frequency. One of these output signals is indicative of the detection of an article and is applied to suitable counting and/or control circuitry which provides the desired count and/or control outputs.

8 Claims, 3 Drawing Figures

ARTICLE DETECTION SYSTEM AND METHOD

BACKGROUND OF THE INVENTION

As indicated in commonly assigned Zenger et al. U.S. Pat. No. 3,686,820, it is customary in the manufacture of many containers, e.g., cans, to make the main container body and container ends separately, the container ends then being packaged for shipment to various locations where the completed container is produced.

The above identified Zenger et al. patent discloses and claims an improved method and apparatus for automatically handling nestable articles, such as container ends. In particular, that patent is directed to a method and apparatus for arranging the disc-like articles or container ends in face-to-face relationship in a plurality of stacks and encasing the stacks in a film of flexible material. it is imperative that these stacks include at least a selected minimum number of container ends in order to insure that there are a sufficient number for producing the completed container.

In practice, the number of ends in a stack has been approximated, for example, by measuring the overall length of the stack, on the assumption that a stack of given dimension contains a certain number of ends. This assumption is only true as an approximation, since the number of ends in a stack of given length can vary depending on how tightly the ends are packed. It has been the practice, therefore, to add a few "extra" ends to the stack to insure that the stack contains the desired minimum number.

At production rates of about 2000–2200 ends per minute, which is typical, these "extras" can result in a substantial cost override since the customer is billed only for the number of ends that are supposed to be in the stack. Even so, the cost of the "extra" ends has been less than the time and expense required to accurately count ends for each stack.

The desirability of eliminating these excess costs by accurately and efficiently counting ends for each stack without cutting production speed requires no elaboration.

SUMMARY OF INVENTION

In accordance with the present invention there is provided a system for reliably detecting and counting articles, such as, for example, container ends, and for providing an output suitable for effecting desired control functions. The article sensing, detection and counting system of the present invention is reliable because of its sensitivity, thereby producing an accurate count of articles being detected; because it is designed to minimize errors resulting from variations in ambient conditions; and because it compensates for internal variations in system operation to minimize errors that might result from such variations.

In accordance with the present invention, a frequency sensitive detector circuit generates a fixed frequency signal which is utilized to modulate the output from a signal generating transducer or signal source. The modulated output from the source impinges on an article being sensed, which reflects or interrupts this signal. This reflection or interruption is sensed by a suitable transducer or sensor, which generates a feedback signal fed back to the frequency sensitive detector which generated the original fixed frequency signal.

The use of a single circuit for generating the fixed frequency modulating signal and for detecting the sensed reflected signal insures that variations in frequency of the modulating signal will not affect system operation since the frequency of the detected signal is the same as the frequency of the original modulating signal.

The frequency sensitive detector responds to the feedback signal generated by the sensor to generate a detection signal representative of the fact that an article has been sensed and detected. This detection signal is suitably processed and may be utilized to provide a count of the number of articles sensed, or may be utilized to operate suitable output control circuitry.

For example, referring to the aforementioned Zenger et al. U.S. Pat. No. 3,686,820, the detection and counting system of the present invention may be used to count the ends being formed into a stack and thereafter effect operation of the stacking mechanism.

Numerous other advantages and features of the present invention will become readily apparent from the following detailed description of the invention and of one embodiment thereof, from the claims and from the accompanying drawings in which each and every detail shown is fully and completely disclosed as a part of this specification in which like numerals refer to like parts.

Figure 1:
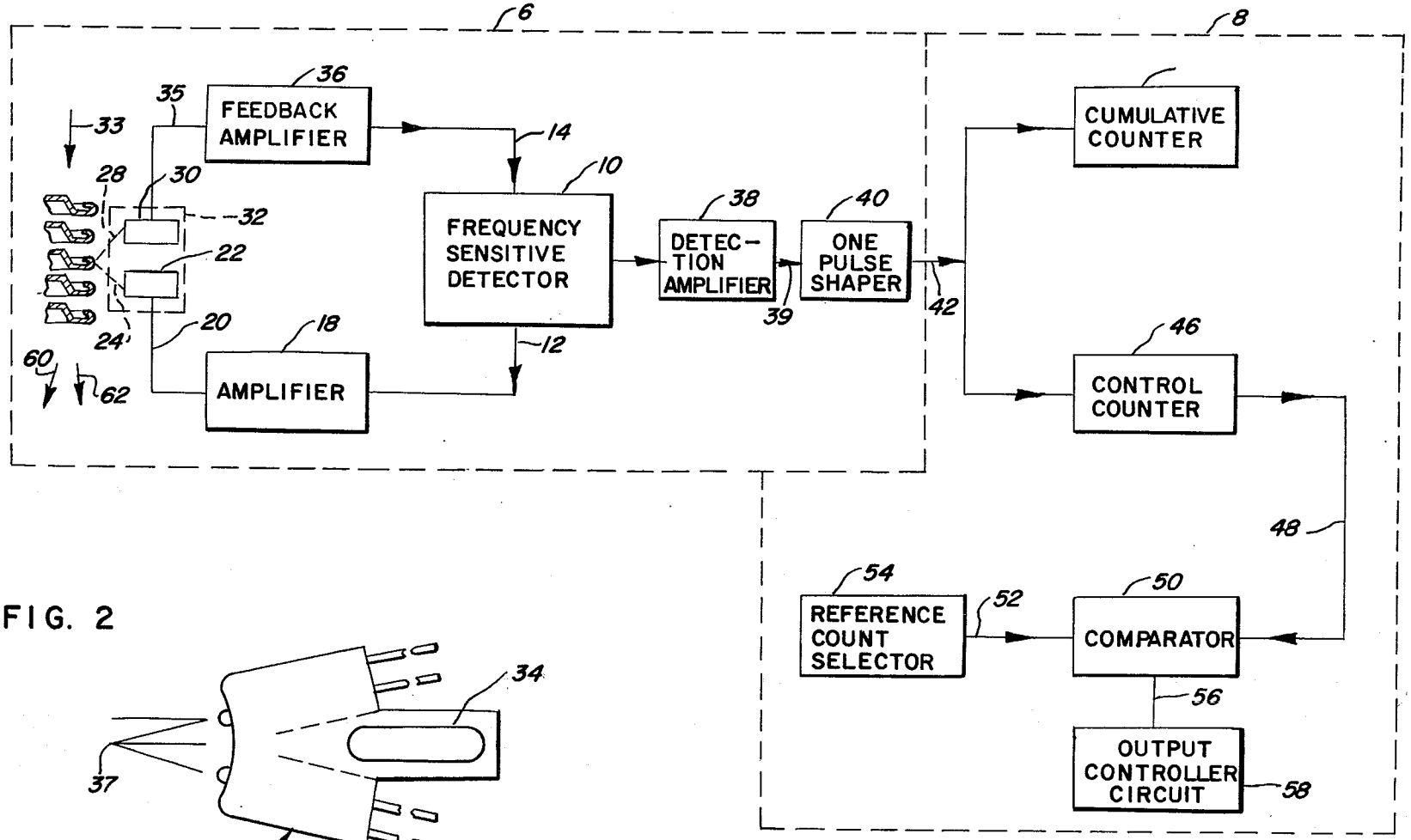
FIG. 1 is a block diagram of one embodiment of a system in accordance with the present invention.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

The article detection and counting system of the present invention may be conveniently described as having a sensing and detection section 6, and an output or counting and control section 8. The sensing and detection section 6 includes a frequency sensitive detector 10 which is a circuit for generating a fixed frequency modulating signal at its first output 12. The frequency sensitive detector 10 is reponsive to a signal of the same fixed frequency at its feedback input 14 to generate a detection signal at its second output 16.

The fixed frequency modulating signal generated at the output 12 of the frequency sensitive detector 10 is amplified by a pulse amplifier 18. The amplified fixed frequency modulating signal is applied over line 20 to the input of a suitable signal generating transducer or sensing signal source 22 to modulate the sensing signal generated thereby.

The modulated sensing signal 24 is directed outwardly into the path of the objects to be detected, e.g., into the path of a plurality of can ends 26 which are to be counted. The signal 24, as seen in FIG. 1, is reflected off the edge 26*a* of each can end 26. The reflected signal 28 is sensed by a signal sensor or transducer 30 responsive to the type of signal generated by the signal source 22.

For convenience and for sensing accuracy, the transducers 22, 30 may be combined in a single assembly 32.

The reflected signal 28 causes sensor 30 to generate a fixed frequency signal at its output 35, which signal is amplified in a suitable feedback amplifier 36. This amplified signal is fed back to the input 14 of the frequency sensitive detector. The signal source 22 is of the type which produces a sensing signal modulated by the amplified fixed frequency signal which can be reflected off of the article being sensed. One type of signal source suitable for use in the disclosed system is an infrared light emitting diode. The signal source is selected to minimize the possibility of erroneous sensing detection due to variations in ambient conditions, e.g., a modulated infrared light emitting diode is used to minimize errors due to variations in ambient light.

In the case where the signal source 22 generates a sensing signal in the form of a modulated infrared light beam, a suitable sensor 30 would be a phototransistor.

Figure 2:
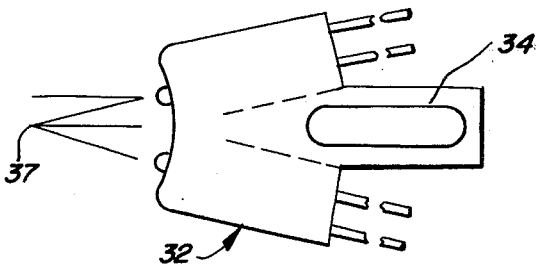
FIG. 2 shows one embodiment of a transducer assembly suitable for use in the system of FIG. 1.

One suitable solid state light source and sensor assembly 32 which can be utilized with the system of the present invention is shown in FIG. 2. The disclosed assembly 32 is a Spectronics SPX–1401–1 compact reflective assembly which combines a solution-grown GaAs Light-Emitting Diode and a silicon NPN phototransistor both hermetically sealed in a glass-lensed package. This particular transducer assembly is designed to operate at an optimum distance of 0.200 inch from the reflective surface. The assembly 32 may be slidably mounted adjacent to the article flow path represented by arrow 33 and includes a mounting slot 34 to permit adjustment of the assembly 32 to the desired distance from the reflective surface of the articles being sensed.

In the disclosed embodiment, the frequency sensitive detector 10 generates the fixed frequency modulating signal which is amplified by pulse amplifier 18 and which modulates the infrared light beam produced by the infrared solid state light source 22. The infrared light beam 24 generated by light source 22, oscillates at the fixed modulating frequency. As each end 26 passes the focal point 37 of transducer assembly 32, the oscillating infrared light signal is reflected from the edge 26*a* of each end 26. The reflected light 28 is sensed by the phototransistor 30 which generates a signal of corresponding frequency. This phototransistor output signal is amplified in the feedback amplifier 36 and fed back to the input 14 of the frequency sensitive detector 10.

A detection signal is generated at output 16 of the frequency sensitive detector in response to the appearance at its input 14 of the amplified phototransistor signal of the same fixed frequency that was generated by the detector 10. The detection signal is amplified in a detection amplifier 38, the output 39 of which triggers a one-shot pulse shaper 40.

The one-shot pulse shaper 40 generates a detection pulse at its output 42 each time it receives an input. Each detection pulse generated by the one-shot pulse shaper corresponds to the detection signal generated by the detector 10 which is generated in response to the signal generated by transducer 30 each time it senses signal 28 reflected off of one of the articles 26. The detection pulses generated by the one-shot pulse shaper, i.e., the output of the sensing and detection section 6, is the input to the counting and control section 8.

In the illustrated embodiment, the detection pulses generated by the one-shot pulse shaper 40 are applied to a cumulative counter 44 which keeps a running count of the total number of articles detected.

The detection pulses may also be used to operate any suitable control circuit. In the embodiment shown in FIG. 1, detection pulses are applied to a control counter 46 the output 48 of which is applied to one input of a count comparator 50. The output 52 of a reference count selector circuit 54 provides the other input to the count comparator 50, which generates a control output 56 when the count of the control counter 46 equals the preset count of the reference count selector 54.

The control output 56 activates any suitable output control circuit 58 such as, for example, a solenoid which might be used to operate a gate for directing the articles along to alternative paths, indicated by arrows 60, 62, to form separate stacks of articles after a selected number of such articls, as determined by the reference count selector 54, have been detected.

Figure 3:
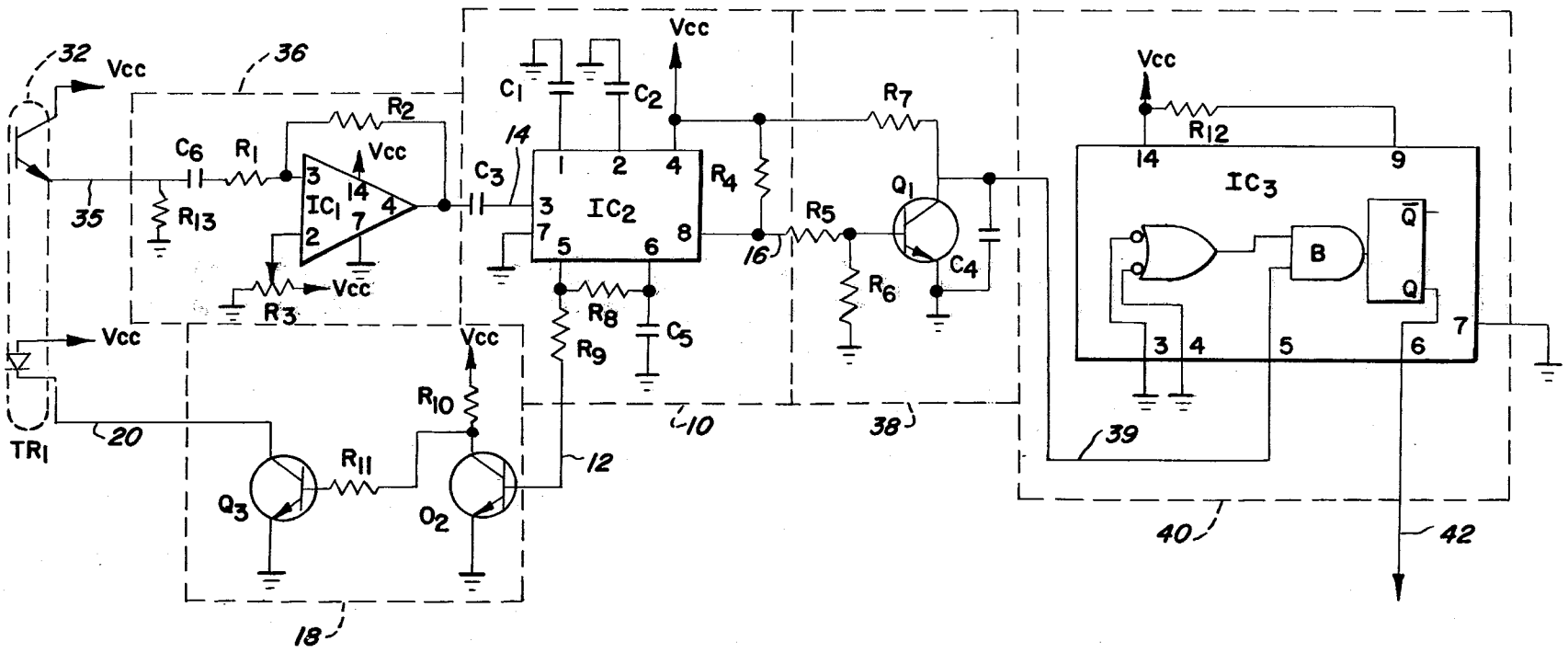
FIG. 3 is a circuit diagram of a portion of the system of FIG. 1.

FIG. 3 shows a schematic diagram of a portion of the system shown in FIG. 1. The specific components utilized in the circuit of FIG. 3 are identified in the following table:

| | | | |
|---|---|---|---|
| $TR_1$- | Spectronics SPX-1401-1 REflective Sensor Assembly | | |
| $C_1$ | 0.1 uf | | 20 W.V.D.C |
| $C_2$ | 0.022 uf | | 20 W.V.D.C. |
| $C_3$ | 0.005 uf | | 20 W.V.D.C. |
| $C_4$ | 1 uf | | 20 W.V.D.C. |
| $C_5$ | 0.022 uf | | 20 W.V.D.C. |
| $C_6$ | 0.005 uf | | 20 W.V.D.C. |
| $IC_1$ | Motorola MC3401 Operational Amplifier | | |
| $IC_2$ | Signetics NE567 Phase Lock Loop Decoder | | |
| $IC_3$ | Texas Instruments SN741211 Monostable Multivibrator | | |
| $R_1$ | 10k | ohm | ½ watt |
| $R_2$ | 100k | ohm | ½ watt |
| $R_3$ | 10k | ohm | ½ watt |
| $R_4$ | 100 | ohm | ½ watt |
| $R_5$ | 10k | ohm | ½ watt |
| $R_6$ | 3.9k | ohm | ½ watt |
| $R_7$ | 1k | ohm | ½ watt |
| $R_8$ | 6.8k | ohm | ½ watt |
| $R_9$ | 10k | ohm | ½ watt |
| $R_{10}$ | 100 | ohm | ½ watt |
| $R_{11}$ | 2.2k | ohm | ½ watt |
| $R_{12}$ | 47k | ohm | ½ watt |
| $R_{13}$ | 10k | ohm | ½ watt |
| $Q_1$ | 2N3904 | | |
| $Q_2$ | 2N3903 | | |
| $Q_3$ | 2N3903 | | |

The numbers within each of the integrated circuits $IC_1$, $IC_2$ and $IC_3$ identify pin numbers to which the various components are connected, as shown in FIG. 3.

In the disclosed embodiment, the modulating signal is generated by the frequency sensitive detector at a nominal design frequency of 6.6KHz ± 10%. At this frequency, about 3 to 5 cycles received at the feedback input of the frequency sensitive detector is sufficient to initiate a detection signal, and, as a result, the potential sensing and detection capabilities of the system far exceed expected operating requirements of the system.

For example, in the article handling system disclosed in the aforementioned Zenger et al. U.S. Pat. No. 3,686,820, ends may be delivered to a stacking mechanism at a rate of about 2000–2200 pieces per minute. At this feed rate, it is estimated that about 160 to about 215 cycles could be reflected from the edge of each end as it moves past the transducer assembly, well in excess (by about 3000% to about 7000%) of the minimum number of cycles needed to trigger the detection signal.

Under these conditions, the system is operating well within its capabilities of providing an accurate count of the number of articles or can ends. As indicated, the use of a pulsed infrared light further reduces the possibility of error by minimizing the effect of ambient light conditions, since it is unlikely that ambient light sensed by the photocell will include an infrared component of sufficient amplitude oscillating at the fixed modulating frequency.

In the system operational mode described above, an "off-on" mode, the feedback signal of fixed frequency occurs only in response to the sensing of the reflected oscillating infrared light (or other sensing signal). In this mode, the detection signal, generated by the frequency sensitive detector, in response to a feedback signal oscillating at the fixed frequency, occurs in response to the sensing of an article.

Alternatively, the system could be designed to operate in an "on-off" mode. In this mode, the fixed frequency modulating signal is also fed back through the feedback amplifier so that the frequency sensitive detector is normally producing a "non-detection" signal. When an article is sensed, the amplitude of the input to the feedback amplifier is modified to saturate the operational amplifier causing the output of the feedback amplifier to go to d.c. A d.c. output from the feedback amplifier terminates the fixed frequency feedback signal and thereby the "non-detection" signal being generated by the frequency sensitive detector. In this operational mode, the detection signal is the absence of an output generated by the detector. Furthermore, the operational amplifier used in this embodiment would probably be an a.c. amplifier so it would not saturate in response to increase in the amplitude of the d.c. signal level, which might occur in response to changes in ambient conditions.

This embodiment would find one application, for example, when the signal source and sensor are located on opposite sides of the article feedpath. Under these conditions, each article being sensed would interrupt the sensing signal impinging thereon, thereby terminating the fixed frequency feedback signal as described above.

Thus, in accordance with the present invention there is disclosed an article sensing, detection and counting system capable of accurately and reliably sensing articles to be counted, and of providing a detection signal for each article sensed. The detection signal may be used to operate suitable control circuitry such as a stack selection mechanism when it is desired to produce stacks with a selected number of articles, thereby eliminating the necessity of including in each stack a number of free "extras" pieces.

It can be appreciated that at a rate of 2200 articles a minute, the additional cost of about 1–4% accumulates rapidly into a significant added expense item and, therefore, the ability to reliably and accurately sense, detect and count such articles effects a significant cost reduction in materials, and permits the use of high speed automated systems.

From the foregoing, it will be observed that numerous variations and modifications may be effected without departing from the true spirit and scope of the novel concept of the invention. It is, of course, intended to cover by the appended claims all such modifications as fall within the scope of the claims.

I claim:

1. An article sensing and detection system comprising:

first transducer means for generating a sensing signal adapted to impinge on an article to be sensed;

frequency sensitive circuit means generating a continuous fixed frequency modulating signal, said frequency sensitive circuit means being responsive to a signal of said fixed frequency at its input for generating a first output and being responsive to the absence of a signal of said fixed frequency at its input for generating a second output;

first circuit means for applying said fixed frequency modulating signal to said first transducer means to effect oscillation of said sensing signal at said fixed frequency;

second transducer means for sensing said oscillating sensing signal, said second transducer means being responsive to said oscillating sensing signal impinging on an article to be sensed for generating a feedback signal respresentative thereof and oscillating at said frequency;

second circuit means for coupling said oscillating representative feedback signal to the input of said frequency sensitive circuit means;

said frequency sensitive circuit means being responsive to the presence a predetermined number of cycles of said oscillating representative feedback signal at its input for generating one of said first and second outputs indicative of the detection of said article.

2. A system as claimed in claim 1 wherein said oscillating sensing signal is reflected off of the article to be sensed, said second transducer means being positioned to receive said reflected oscillating sensing signal and generating said representative signal as said feedback signal oscillating at said frequency;

said second circuit means coupling said oscillating feedback signal to the input of said frequency sensitive circuit means, whereby said frequency sensitive circuit means generates said first output indicative of the detection of said article.

3. A system as claimed in claim 2 including pulse shaping circuit means responsive to said first output for generating a preselected output pulse representative of detection of an article.

4. A system as claimed in claim 3 including output circuit means responsive to said output pulse, means for applying each output pulse to said output circuit means, said output circut means responsive to a selected number of said output pulses for providing a control output.

5. A system as claimed in claim 2 wherein said second transducer means generates said feedback signal having a number of cycles exceeding said predetermined number.

6. An article sensing and detection system comprising:

a frequency sensitive detection circuit for generating a continuous fixed frequency modulating signal, said frequency sensitive detector circuit having an input and being responsive to a predetermined number of cycles of a signal of said fixed frequency at said input for generating a first output;

amplifier circuit means for amplifying said fixed frequency modulating signal, a source of infrared light for generating an infrared light beam, means connecting the output of said first amplifier circuit to said light source to effect oscillation of said light beam at said fixed frequency, said light source including means directing said light beam to a point located in the path of articles to be sensed, said light beam being reflected from the surface of each article passing said point, light sensitive transducer means positioned to sense said reflected light beam and to generate an electrical signal oscillating at said fixed frequency in response thereto, second amplifier circuit means adapted to receive said oscillating feedback signal and for applying said oscillating feedback signal to the input of said frequency sensitive detector means, said frequency sensitive detector means generating said first output in response to the presence of at least said predetermined number of cycles of said oscillating feedback signal at the input thereof.

7. A system as claimed in claim 6 wherein said frequency sensitive detector means generates said modulating signal at a nominal frequency of 6.6KHz said frequency sensitive detector means generating said first output in response to the presence at its input of from about 3 to about 5 cycles of a feedback signal oscillating at said frequency.

8. A method for detecting and counting a plurality of articles moving along a feed path including the steps of:

generating an infrared light beam directed across said feed path to impinge upon and reflect off of each article moving along said path, sensing the reflected light beam off of each article and generating a feedback signal representative thereof;

generating in a frequency detection circuit a continuous modulating signal of fixed frequency for modulating said light beam to effect oscillation of said light beam and said feedback signal at said frequency;

generating a detection signal in response to the coincidence of a predetermined number of cycles of said oscillating feedback signal and said generated modulating signal at said frequency detection circuit, generating a pulse in response to each such detection signal, counting each pulse to determine the number of articles sensed, and generating a control output each time a preselected number of pulses have been counted.

* * * * *